US005300914A

United States Patent [19]

Hartman et al.

[11] Patent Number: 5,300,914

[45] Date of Patent: Apr. 5, 1994

[54] DROPOUT EXPULSION FUSE

[75] Inventors: Thomas C. Hartman, Allegany; Stephen P. Johnson, Olean; Paul R. Desnoyers, Allegany; William E. Hurlburt; Robert N. Schettler, both of Olean; Walter R. Materna, Allegany, all of N.Y.

[73] Assignee: Cooper Power Systems, Inc., Houston, Tex.

[21] Appl. No.: 891,769

[22] Filed: Jun. 1, 1992

Related U.S. Application Data

[63] Continuation-in-part of Ser. No. 645,076, Jan. 23, 1991, Pat. No. 5,119,060.

[51] Int. Cl.[5] ..... H01H 85/143; H01H 85/165

[52] U.S. Cl. ..... 337/249; 337/217; 337/251

[58] Field of Search ..... 337/249, 247, 248, 251, 337/252, 203, 217, 218, 219, 220, 180, 181

[56] References Cited

U.S. PATENT DOCUMENTS

| | | | |
|---|---|---|---|
| 1,629,266 | 5/1927 | Feldkamp . | |
| 1,944,762 | 1/1934 | Sandin . | |
| 2,157,152 | 5/1939 | Triplett . | |
| 2,243,135 | 5/1941 | Triplett . | |
| 2,253,719 | 8/1941 | McMahon . | |
| 2,416,428 | 2/1947 | Boothe . | |
| 2,662,138 | 12/1953 | Lindell et al. . | |
| 2,859,307 | 11/1958 | Enk . | |
| 3,735,315 | 5/1975 | Swarbrick et al. | 337/290 |
| 4,121,187 | 10/1978 | Mahieu | 337/171 |
| 4,161,714 | 7/1979 | Jacobs, Jr. | 337/253 |
| 4,174,530 | 11/1979 | Kresge et al. | 361/127 |
| 4,272,751 | 6/1981 | Biller et al. | 337/231 |
| 4,349,803 | 9/1982 | Tobin | 337/186 |

*Primary Examiner*—Harold Broome
*Attorney, Agent, or Firm*—Donald J. Verplancken

[57] ABSTRACT

A fuse is provided for protection of high current power distribution equipment, such as transformers. The fuse includes a dual function fuse element having a solder pot which permits fuse opening in response to long-term current overload conditions, and a minimum cross-section wire portion for short circuit opening. The fuse element is enclosed within a tube, and the tube is received within a housing. The tube is closed off on one end thereof with a dual size button, which size is selectable for reception into the housing.

19 Claims, 5 Drawing Sheets

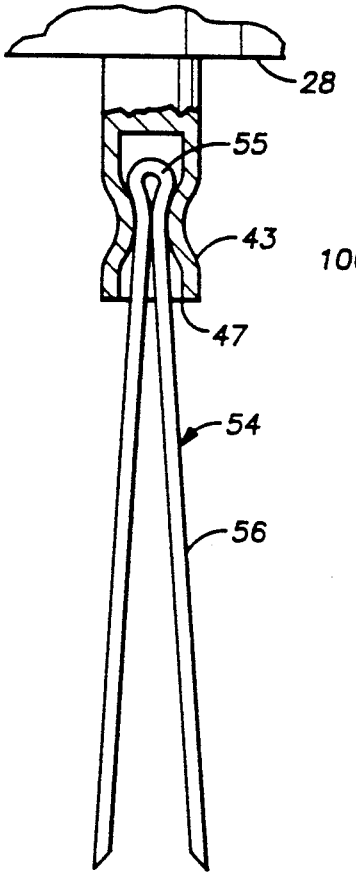
FIG. 4
FIG. 7
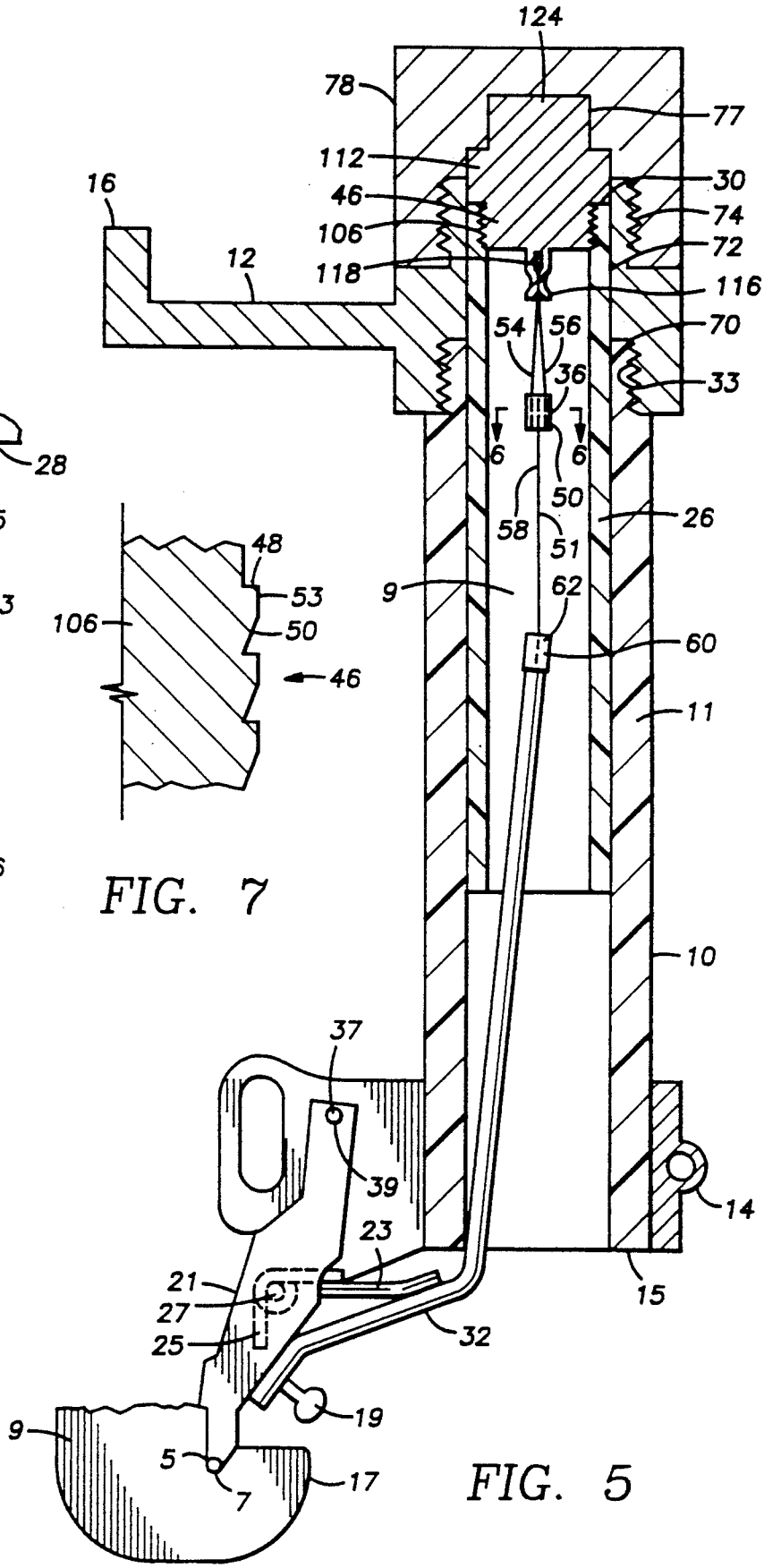
FIG. 5

DROPOUT EXPULSION FUSE

RELATED APPLICATIONS

This is a continuation-in-part of U.S. patent application Ser. No. 07/645,076, filed Jan. 23, 1991 now U.S. Pat. No. 5,119,060.

BACKGROUND OF THE INVENTION

This invention relates to the field of power transmission and distribution equipment, more particularly to the field of protective devices for power transmission and distribution equipment, and more particularly still to the field of localized protection of power transmission and distribution equipment, such as transformers and surge arresters.

Transformers placed on poles, or at remote distribution sites, are subject to the ravages of weather upon the distribution system components. If lightning hits a wire or the transformer, an electrical surge will pass through the distribution conductor feeding the transformer. To help prevent these disruptive weather related occurrences from destroying the distribution equipment, surge arresters and fuses are placed in the distribution network immediately adjacent the transformer, or other component, which is to be protected. The surge protector is normally disposed in an electrical parallel configuration with the transformer. During normal, steady state operations, the surge arrester has a very high resistance to ground, and therefore, nearly all of the current in the distribution conductor leading to the transformer passes through the transformer. However, when a surge in the form of a high current spike is detected by the arrestor, the resistance of the arrester drops precipitously to a level substantially lower than that of the transformer, and the surge arrester diverts the surge to ground. Once the surge has passed or dissipated, the arrester once again returns to the high resistance state to re-energize the transformer.

Fuses are used to further protect the transformers located on poles or at remote locations in the distribution network. Power lines coming into the transformer are typically rated at between one half and 100 amps, supporting voltages of between 2400 and 38000 volts thereon. The fuses are commonly placed in a parallel electrical relation to the surge arrestor. The fuse, and transformer, are mounted in series and these two components in series are then mounted in an electrically parallel configuration to the surge arrestor. The arrestor provides protection to the transformer by diverting surges, such as those caused by lightning, to ground, rather than through the fuse and transformer combination and into the rest of the distribution network. The fuse provides long-term overload protection to the circuit, such as what occurs when a short appears as a result of a failure in the transformer or a long-term over load situation is present in the secondary circuit. However, the fuse is not intended to carry the lightning surge to ground. The prior art fuses cannot withstand the full surge current created during a lightning strike, and thus the surge arrestor must be placed in parallel with the series combination of the transformer and fuse to protect both the transformer and the fuse.

To physically locate the surge arrestor and fuse-transformer combination in a parallel electrical configuration, the surge arrestor and fuse are both placed upon the pole, pad, or other mounting location, or otherwise remotely located from the transformer tank, and the ground lead is run from the transformer tank to the surge arrestor. This arrangement leads to less protection of the transformer windings than would be present if the surge arrester were mounted directly on or in the transformer tank. It is known that the longer the length of the lead between the transformer and surge arrestor, the greater the likelihood of damage occurring to the transformer windings during a current surge condition. However, the prior art fuses dictate that the surge arrestor be remotely mounted so that the surge current does not pass through the fuse while protecting the transformer.

The individual fuse associated with a transformer must be sized to protect the transformer, and not prematurely open in response to rated amperage or slight overload conditions. Each transformer will have a specific rated primary amperage and voltage which must pass therethrough to provide the proper voltage and amperage on the secondary, or low voltage, side thereof. Likewise, as the rated amperage and voltage of the transformer varies from application to application, the fuse which protects the transformer must be sized to match the performance rating of the transformer. Therefore, the fuse manufacturer typically must supply a line, or group of fuses with different opening amperages, for proper transformer protection for any given range of transformers. These requirements are well known in the art, and handbooks, design manuals and government and industry standards are promulgated which dictate to designers the power absorption, time to open or blow, and overcurrent characteristics of fuses for high energy applications.

Prior art fuses employ a variety of materials as fusing links, or wires. The link, or wire, serves as the fusing element in the fuse which severs or opens in response to an overload or surge condition. The fusing link must be capable of withstanding, or carrying, a low current overload for some period of time without opening, but must also be capable of rapidly opening within a period of time as short as one one-hundredth of a second, when a fault or short circuit appears across the fuse. The required opening time for any given overload condition is governed by government standards which are well-known to those skilled in the art.

During surge openings, when the current passing through the fuse is the equivalent of a short circuit, the fusing link locally vaporizes at a point thereon between the button and leader. The leader is attached to one end of the fusing wire, in a large crimp. The cross-section of the crimp physically blocks off approximately two-thirds of the internal cross-sectional area of the auxiliary tube. The leader is spring-loaded with a spring flipper, so that upon a fuse opening, the severed wires will be physically pulled apart by the spring flipper actuating the leader outward the bottom of the fuse. Additionally, the crimp is substantially larger than the fusing wire, and the gasses generated during a fuse opening generate pressure within the tube, which bears upon the upper area of the crimp to create a differential pressure thereon to help speed up the ejection of the severed fuse link from the auxiliary tube.

To obtain the above-referenced fuse opening characteristics, fuse designers must use materials with well-known properties and then physically size and shape the fusing link to accommodate the limitations of the fusing material while still obtaining the required fusing characteristics. One very common fusing link material is tin.

Tin is a relatively inexpensive material which has well-known fusing properties. However, tin has several disadvantages when used as a fusing link material. When tin wire is required to sustain, or carry, a long-term circuit overload to a fusing termination, for example a current of 200% fuse rated capacity for a sufficient length of time to cause the fuse to open, the tin wire is incapable of sufficiently dissipating the resistance heat generated by the current flowing therethrough. As a result, the fusing link opening will occur as a localized explosion at the transverse location in the tin wire where maximum heating, in relation to localized wire heat dissipation, occurs. The explosive opening is a natural result of the resistance heat generating and heat dissipation characteristics of tin which the fuse designer must accommodate in the fuse design. This "explosive" opening is a metalized vapor created out of the vaporized tin fusing wire, which splatters out against the walls of the auxiliary tube. This metalized vapor is conductive, and electric current will continue to pass through the fuse and arc through the metalized vapor for a period of time. The arc will continue to generate until the severed ends of the fusing wires are separated a sufficient distance to create a sufficient gap therebetween which is greater than the gap-bridging power capacity of the arc. It should be appreciated that where the arc is sustained on fuse wire metal deposited on the sides of the auxiliary tube, the separation distance necessary to stop the arcing is greater than were air only present in the gap, because the electric resistance of air is several orders of magnitude greater than that of tin. If the arcing condition persists, the arc will begin burning the inside of the auxiliary tube, leading to a possible fire. In addition to the fusing deficiencies of tin, tin wires have a low tensile strength, and therefore a secondary wire made from a stronger material, such as ni-chrome, must often be used in parallel with the tin wire to support the tensile forces needed in a fuse. The use of the two parallel wires causes undesirable discontinuities in the fusing characteristics of the fuse, as both must sever to open the fuse.

In addition to tin, silver is another common fusing link material. Silver has a higher strength, but lower resistance and higher cost than tin. To compensate for the lower resistance of silver as compared to copper, the fusing link must be thicker and longer. The longer link will sometimes sag during overload conditions, causing it to contact the side of the auxiliary tube and scorch or burn the tube, creating altered fusing characteristics and the possibility of fire.

SUMMARY OF THE INVENTION

The present invention is an improved surge durable dropout expulsion fuse used to protect transformers in a distribution network. The invention includes a precision-crafted, moisture-resistant housing for protecting the fuse circuit, a knurled barbed conductive button, having a selectively removable enlarged head portion, press fitted into one end of the tube, a leader wire projecting out the other end of the tube, and a solder pot with fusing links interconnecting the button and leader to provide an interruption means for opening the circuit during long-term and surge overload conditions, all of which are mounted within a dropout expulsion housing. The solder pot is a cylindrical annular segment, comprised of a single wire wound into a cylindrical coil into which a plurality of wire elements are directed from the button and from the leader. The elements are manufactured to a close tolerance, such that the total cross sectional area of the elements on each side of the solder pot is a specified value for each class of fusing link, or element, base material. The selectively removable enlarged head portion on the button is sized to be received in a specific fuse receptacle, and may be removed to expose a smaller, permanent, head portion for receipt in a smaller receptacle where such a smaller bore receptacle is encountered.

The improved link may be used as a fuse in series with a surge arrestor to protect a transformer from overload and surge conditions. In this configuration, the high voltage line into the transformer and surge arrester is protected by the fuse, and this fuse protected line splits into parallel conductive circuits leading to the surge arrestor and the transformer. Because the fuse no longer needs to be placed in parallel with the arrester, the surge arrester may be remotely located from the fuse, closer to the transformer or even in the transformer, thereby increasing the protection of the transformer windings.

The use of elements having a specified minimum cross-sectional area permits the fuse to carry a lightning surge without failure, while at the same time being capable of precision opening in response to low circuit overload conditions, because overload fusing is controlled by the solder pot and not the minimum cross-section of the fusing link or wire. When a surge occurs due to a lightening strike, the fuse in most cases will carry the entire energy of the surge without opening, and the surge will then pass through to the surge arrestor-transformer parallel combination. At this point, the surge arrestor will create a very low impedance path therethrough to ground, thereby diverting most of the surge energy to ground and not through the transformer. This permits the surge arrestor to be mounted in or on the transformer to reduce or eliminate the lead length between these components. This lower lead length increases the effective ability of the surge arrestor to protect the primary coils of the transformer from overload surges.

To maximize the fuse design flexibility allowed by the use of the pot, the two fusing links may be made from different materials or may have different sizes to ensure that fusing occurs in specific locations on the fusing links within the auxiliary fuse tube to maximize fuse performance.

These and other objects and advantages of the invention will become apparent from the following description and accompanying drawings.

BRIEF DESCRIPTION OF THE DRAWINGS

For a detailed description of the invention, reference will now be made to the following drawings, wherein:

FIG. 4 is a side view of a portion of the fusing wire mounted in the button shown in FIG. 2, with the button shown in partial section;

FIG. 5 is a sectional view of an alternative embodiment of the plug and auxiliary fuse tube of FIG. 1 with the enlarged head portion removed at section 5—5 with the fuse tube of FIG. 2 therein;

FIG. 7 is an enlarged, partial sectional view of the barbs on the button of FIG. 3;

BRIEF DESCRIPTION OF THE PREFERRED EMBODIMENT

Figure 1:
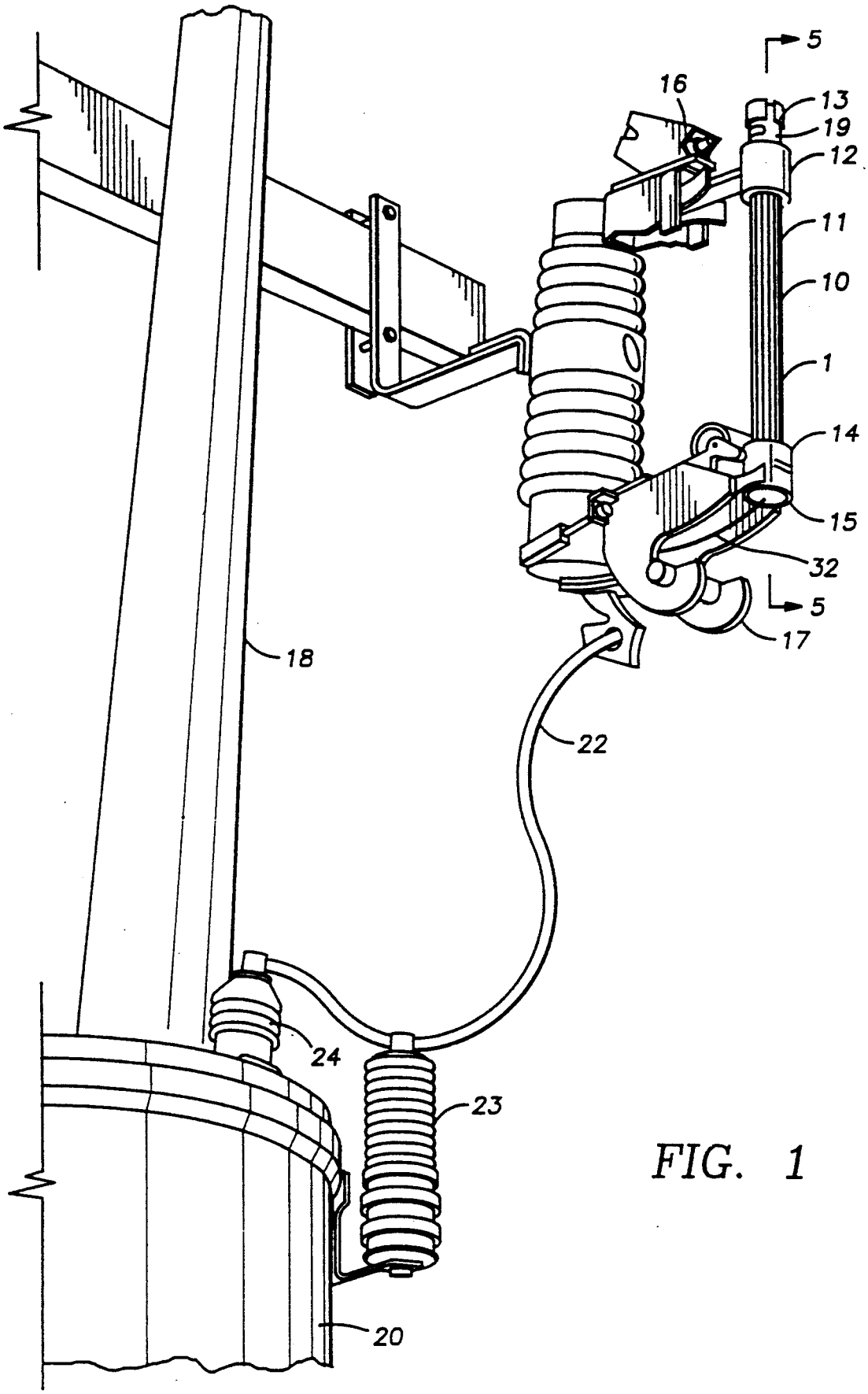
FIG. 1 is a perspective view of the fuse of the present invention mounted in a carrier.

Referring initially to FIG. 1, the fuse 1 of the present invention is housed in a dropout expulsion housing 10 having a protective outer tube 11 with a lower open end 15 and an upper closed end 19 enclosed with a conductive end ferrule 13 mounted thereon. Dropout expulsion housing 10 is retained in fixture 16 having an upper retainer 12 and a lower trunnion 14. The upper end 19 of outer tube 11 is mounted in retainer 12 and the lower end 15 of dropout expulsion housing 10 is mounted in trunnion 14. Fixture 16 may be mounted to a pole 18, or to a housing or other structure to which a transformer 20 is located. The mounting of the dropout expulsion housing 10 within fixture 16 is well known in the art, and examples of several different types of fixtures 16 may be found in U.S. Pat. No. 4,272,751, the disclosure of which is incorporated herein by reference.

Figure 2:
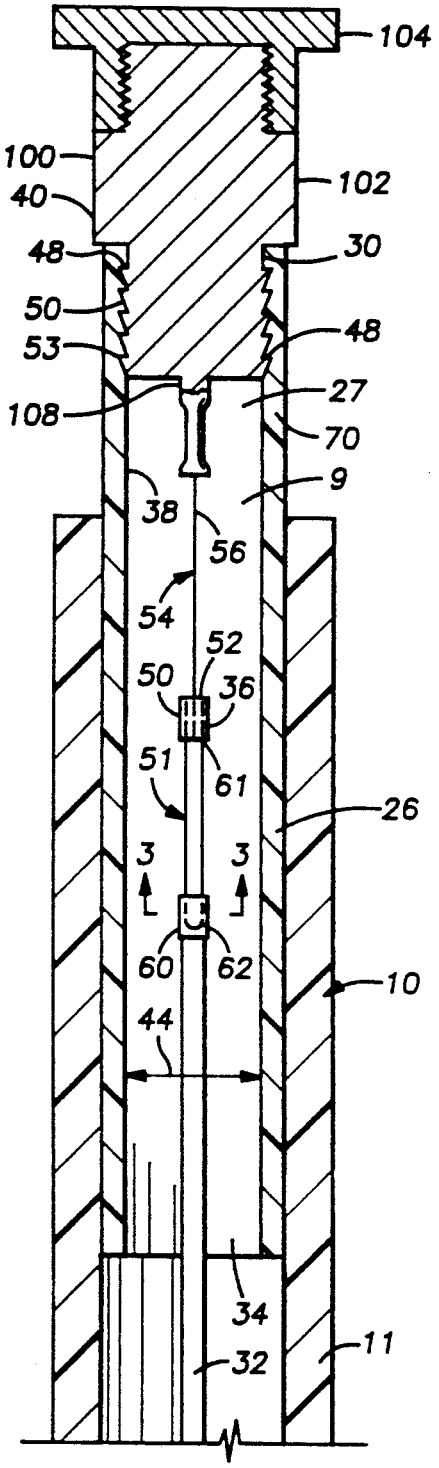
FIG. 2 is a partial view of the fuse of FIG. 1, partially in section, showing the detail of the auxiliary fuse tube button and fusing link.
Figure 6:
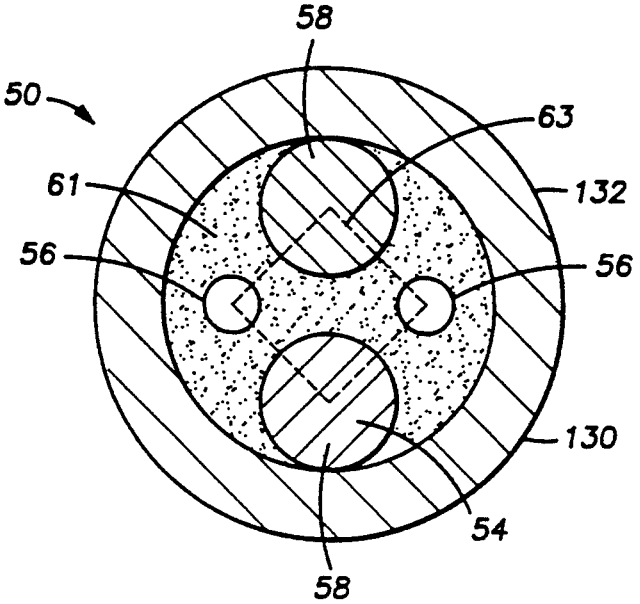
FIG. 6 is a sectional view of the pot of FIG. 5 at section 6—6.
Figure 8:
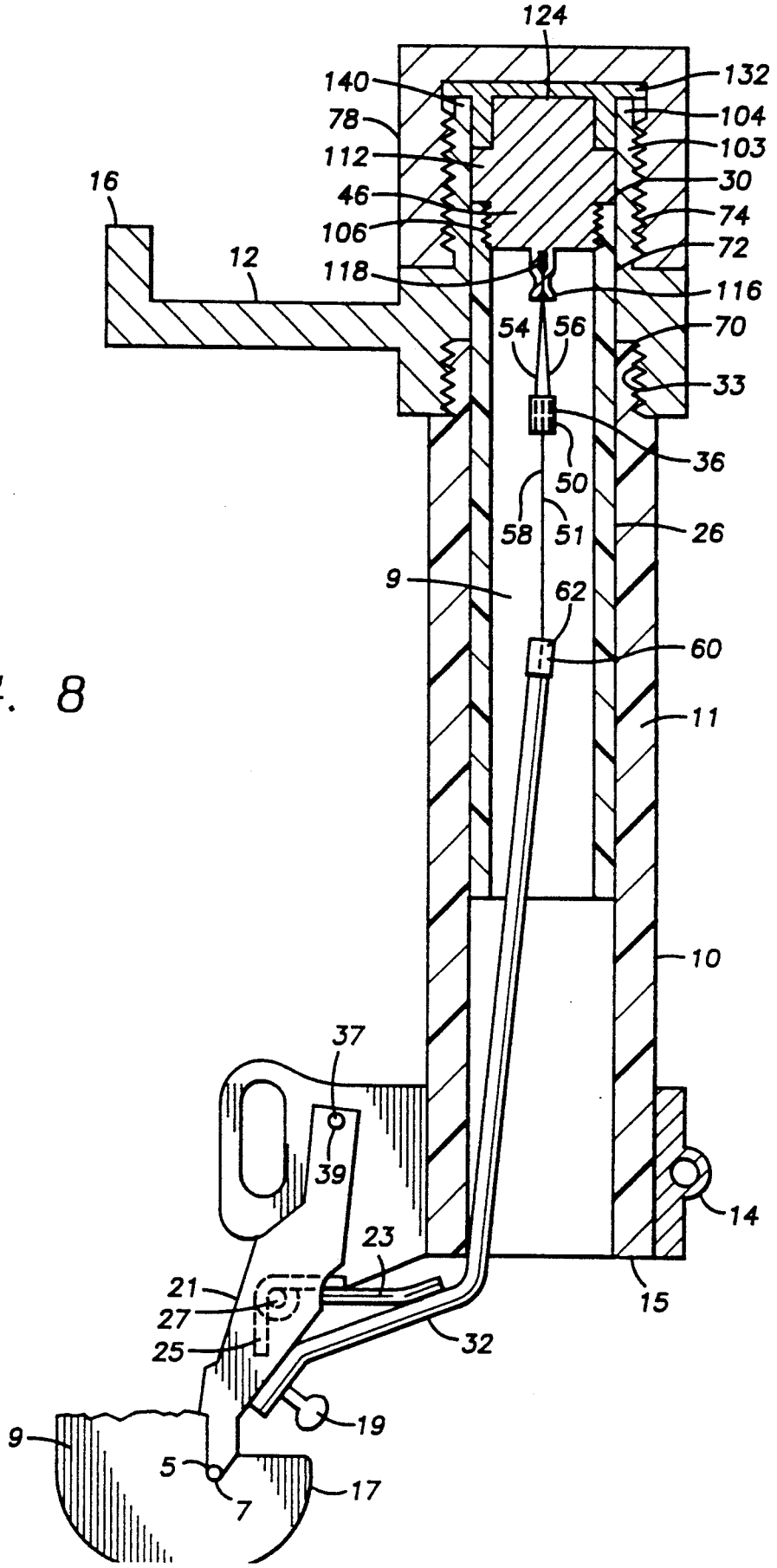
FIG. 8 is a sectional view of the auxiliary fuse tube of FIG. 1 at section 5—5.

Referring now to FIGS. 1, 2 and 8, fuse assembly 9 is held within dropout expulsion housing 10. Housing 10 is located adjacent the transformer 20 to protect transformer 20 from electrical overloads, as will be described further herein. A conductive line lead 22 extends from a high voltage bushing 24 disposed on transformer 20 to surge arrester 23 to the lower trunnion 14 of fixture 16. A leader 32 connected to the fuse assembly 9 of the present invention extends through housing 10 to be ultimately electrically connected with trunnion 14. Likewise, a high voltage lead (not shown) extends from the high voltage service line to the retainer 12. Thus, power is supplied through fuse 1 from the upper retainer 12, which then passes through fuse 1 to transformer 20 and the surge arrestor 23. The surge arrestor 23 is housed in an electrical parallel relationship to the transformer 20 windings, but in a series configuration with the fuse 1. The transformer 20 is likewise in series with the fuse 1. The surge arrestor 23 may also be mounted within the transformer tank to further reduce line losses and thereby enhance the protective capability of the surge arrestor. Upon a fuse 1 opening, fuse assembly 9 may be removed from outer tube 11 and a new fuse assembly 9 inserted therein. This permits relatively easy and fast resumption of service to the transformer.

Referring now to FIG. 2, fuse assembly 9 includes an inner protective auxiliary fuse tube 26 adapted to be disposed within outer protective tube 11 of dropout expulsion housing 10, a button 100 closing one end 27 of tube 26, leader or lead wire 32 extending out of the other open end of tube 26, and a fusing link 36 having one end electrically connected to button 100 and its other end electrically connected to lead wire 32. Fusing link 36 is structured and arranged to permit normal and short-term surge currents to pass therethrough without failure, but will fail in response to a long-term overload condition and to transformer-induced faults.

Outer protective tube 11 of dropout expulsion housing 10 is an electrically insulative tubular member having a diameter sized to receive inner protective auxiliary fuse tube 26. Outer tube 11 is longer than inner auxiliary fuse tube 26 as is hereinafter described with respect to FIG. 5.

Inner protective auxiliary fuse tube 26 is an electrically insulative tubular member having a tubular shell or wall 38 with an internal diameter 44 and opposed open ends 30, 34. The wall 38 of tube 26 is preferably manufactured by spirally winding several bilayers of previously vacuum-impregnated electrical-grade resin for moisture protection, fish and natural dielectric kraft paper. Wall 38 is sufficiently thick to withstand the internal eruption of the internal fuse components in the event of a catastrophic fuse interruption.

Figure 3:
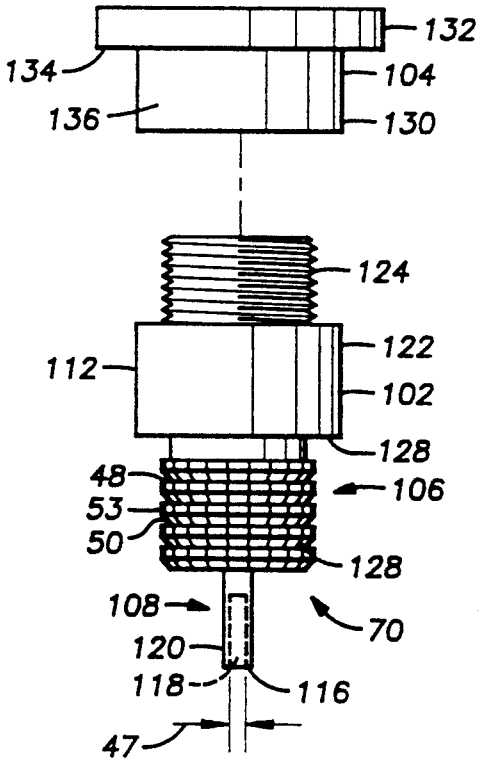
FIG. 3 is a side view of an alternative button having alternative locking teeth to that shown in the fuse in FIG. 2.

Referring now to FIGS. 2 to 4, button 100 is a generally cylindrical member having a solid conductor plug portion 102 and a secondary large head 104 receivable thereon. Button is preferably machined from copper or brass. Plug portion 102 includes a central barbed portion 106, a tongue 108 extending from a first end 110 of barbed portion 106, and a head portion 112 extending from a second end 114 of the central barbed portion 106 opposite from tongue 108. Tongue 108 is a tubular portion disposed substantially concentric with barbed portion 106 and extending outward therefrom to distal end 116. A crimp bore 118 is disposed inward tongue 108 substantially its entire length, surrounded by a thin crimp wall 120. Head portion 112 is likewise substantially concentric with barbed portion 106, and includes first head 122 disposed directly adjacent and contiguous with second end 114 and extension plug 124 extending outward form the end of first head 122. Extension plug 124 is circumferentially sized to be received within a standard end ferrule 13 in upper retainer 12 (best shown in FIG. 5). As end ferrule 13 generally come in several sizes to receive different sized fuse heads, button 100 may be reconfigured by placing a second, large head 104, over plug 124. Large head 104 is a generally cylindrical member having an annular body portion 130 terminating in a large button end 132. Button end 132 is an enlarged portion of large head 104 which forms an overhanging lip 134 which projects radially outward past the outer circumferential surface of body portion 130. Body portion 130 further includes a plug recess 136 therein which receives plug 124 to secure large head 128 on button 100.

Large head 104 and smaller first head 122 are sized to fit in adjacent standard cutout retainer receptacle sizes. For example, a standard retainer 12 may include either an end ferrule 13 having a one-half or five-eighths inch diameter head receptacle, or button bore, therein for receiving fuses. The same size fuse may be placed in either sized end ferrule 13 in upper retainer 12, yet the service technician or lineman may not know, for certain, which size end ferrule 13 in upper retainer 12 is present at a transformer location on which a fuse 1 has opened. For example, the end ferrule 13 in upper retainer 12 might be in a size range where either a one-half or five-eights inch buttonbore 140 is present. Therefore, the lineman will take the one-half inch size head 124 and , if required, press the larger five-eighths inch head 128 over plug 126 to reconfigure the head to be received in a five-eighths inch buttonbore 140.

Referring further to FIGS. 2, 3, and 7, barbed portion 106 includes a series of external barbs 46 which allow insertion of button 28 into end 30 of inner tube 26 but prevent extraction therefrom. Each barb 46 includes a normal face 48 projecting outward from central barbed portion 106 and substantially perpendicular thereto, an extended portion 53 extending along the outer surface of the barbed portion 106 from the outer terminus of face 48, and a tapered portion 50 extending form the terminus of extended portion 53 and circumferentially and axially inward therefrom to the base of the next adjacent face 48. Extended portion 53 is a circumferential section or segment forming the outer circumference of barbed portion 106. Barbs 46 preferably are formed by knurling barbed portion 106 into a series of concentric circles, and then linearly knurling shank 42 parallel to the center line 35 of button 100 evenly about the circumference thereof to form voids 128. This operation will result in a series of individual barbs 46 on the outer circumference of barbed portion 106, each barb bounded by the adjacent linear and circumferential knurls forming the next adjacent barbs, or the upper and lower ends of shank 42. Barbs 46 may be sized such that the lowest depression formed by the knurling operation is equal to the maximum inner diameter 44 of inner tube 26, so that barbs 46 will dig into the inner peripheral surface of inner tube 26 after button 28 is inserted therein. Thus, each barb 46 forms a one way lock which allows the button 100 to be inserted into wall 100 when the button is pressed into inner or auxiliary tube 26, but digs into the inner peripheral surface of wall 38 of inner tube 26 as button 38 is actuated outward from tube 26. By knurling individual barbs 46 into the button 100 as opposed to simply forming circular retaining ridges on the outer circumference thereof, button 100 will more easily enter auxiliary tube 26 with lesser incidence of splitting or cracking of the tube 26, while at the same time forming a greater resistance to removal therefrom. Barbs 26 may also be formed without the extended portion 53 as shown in FIG. 2, and the knurling may be altered from the linear and circumferential knurling to tangential or other knurling patterns.

Referring to FIGS. 2, 3 and 4, tongue 108 is a reduced diameter extension of barbed portion 106 extending opposite from head 40. Tongue 108 is constructed of an electrically conductive material such as steel, copper or brass, and is preferably manufactured as an integral part of barbed portion 106, but may be manufactured separately and press fit, soldered, screwed, or otherwise secured into a hole in the face of barbed portion 106. Tongue 108 is preferably a tubular member, having an internal diameter 47 forming crimp bore 118 which is slightly larger than the width of two fusing leads, as will be discussed further herein. Tongue 108 may also be a solid member with a slot therethrough, or of another configuration which is capable of being interfaced and attached to fusing link 36. For example, the tongue 108 may be manufactured as a solid tubular member, and the fusing wire of fusing link 36 may be wrapped and soldered to the outer surface thereof.

Figure 9:
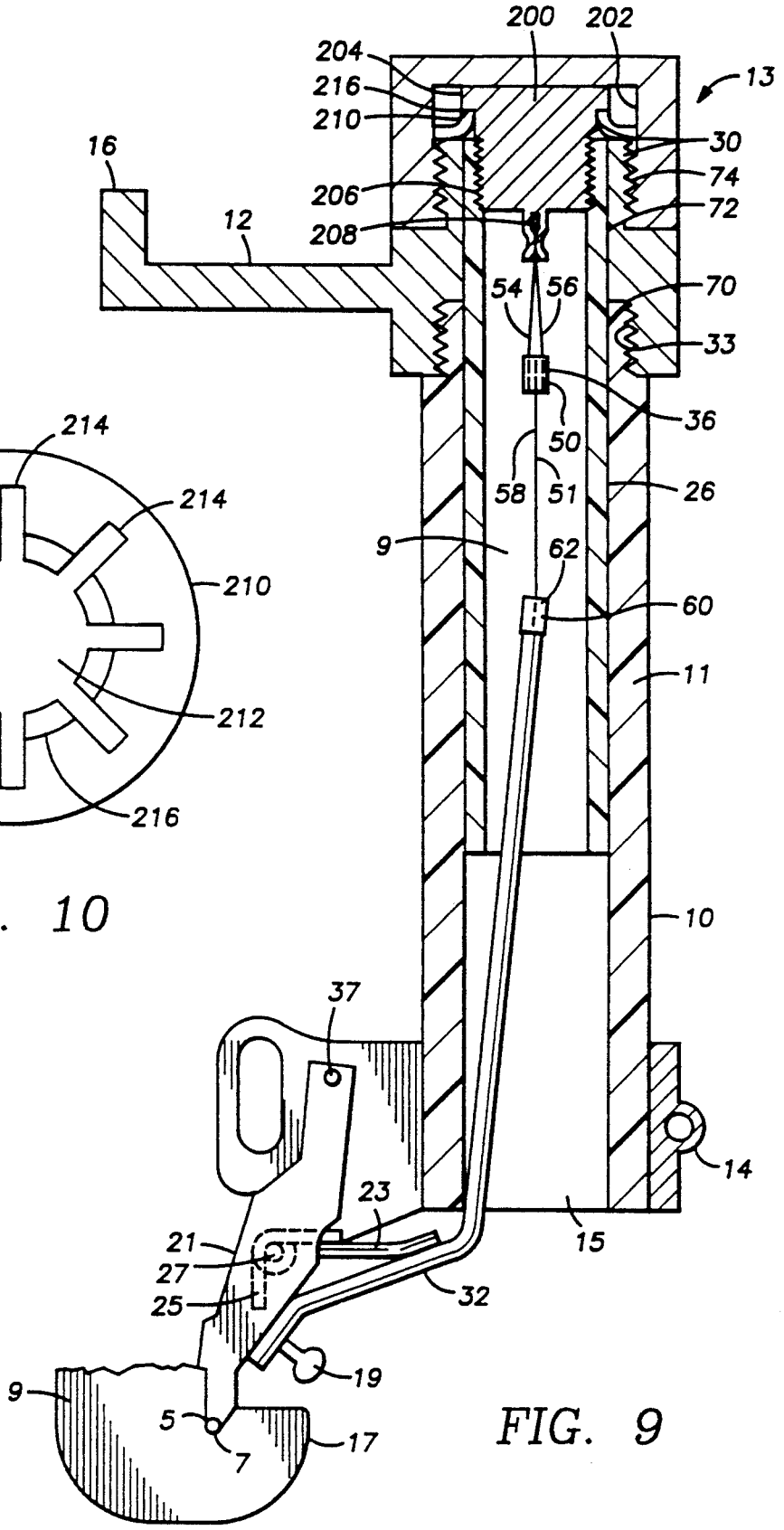
FIG. 9 is a partial view of an alternative embodiment of the fuse, having a modified head and washer portion thereon; and, FIG. 10 is a top view of the washer shown in FIG. 9.

Referring now to FIG. 9, a further embodiment of head 200 is shown. Head 200 is receivable within bore 202 of upper ferrule 13, and includes first minor diameter head portion 204, shank portion 206 and ferrule portion 208. Ferrule 208 receives the looped end 55 of first fusing wire 54. Shank portion 206 includes barbs 46, preferably as shown in FIG. 7, to secure head 200 in tube 26. However, alternative securing means, such as straight barbs, ridges, or other attachment means may be employed without deviating from the scope of the invention. Minor diameter head portion 204 projects from shank 206 into bore 202, but may, in certain circumstances, be diametrically smaller than the inner diameter of bore 202. Where the diameter is substantially the same, head portion 204 is snugly received in bore 202 and retains head 200, and tube 26 attached therein, on ferrule. Where head portion 204 is smaller than bore 202, a secondary washer 210 is provided which snugly fits within bore 202 to retain head 200, and tube 26 attached therein, on ferrule 13.

Figure 10:
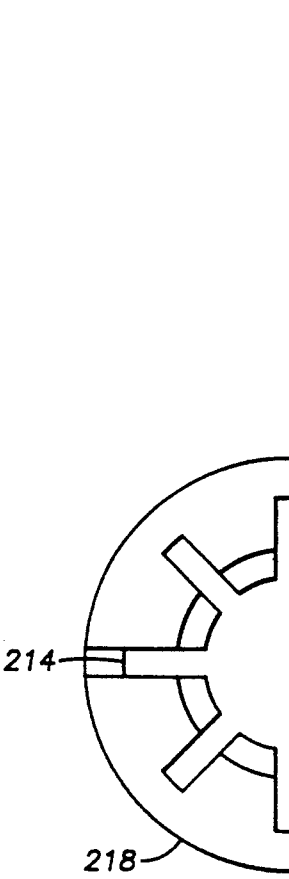

Referring now to FIG. 10, washer 210 is a generally round member having a center aperture 212 therethrough, and a series of radial slots 214 radiating therefrom. Washer 210 is preferably manufactured from Beryllium copper. One of slots 214 radiates through from aperture 212 through to the outer circumference 218 of the washer 210. At the perimeter of aperture 212, washer 210 includes an upward projecting lip 216. Aperture 212 is sized to receive shank portion 206 such that lip 216 engages against the base of head portion 202. The outer diameter 218 of washer 210 is larger than the outer diameter of head portion 202, such that in the situation where bore 204 is larger than head portion 204, outer diameter 218 of washer 210 bears upon bore 202 to interconnect head 200 to ferrule 13.

Washer 210 is used to allow one size fuse 1 to fit dual sized ferrule bores 202, Where, for example, the service technician does not know whether bore 202 is one-half or five eighths of an inch diameter, washer 210 will fit the five eights inch aperture and head portion 202 is sized for the one half inch aperture. When the technician installs the fuse 1, if the bore 202 is only a one half inch opening, washer 210 may be pulled off of head 200, to allow head to be received in bore 202. Likewise, if a five eighths inch bore is encountered, the washer remains on head 200 and washer engages the inner circumference of bore 202 to retain head 200 in bore 202. Electrical contact occurs in two places, the inner periphery of aperture 212 on shank 206, and at the interface of outer diameter 218 and bore 202. By using slots 214, aperture 212 is spring fit on shank 206 as shank 206 is slightly larger than aperture 212. Likewise, the upper terminus of lip 216 is spring-loaded on the base of head portion 204.

Referring now to FIGS. 2 and 4, fusing link 36 of fuse assembly 9 includes a first fusing wire 54, a complex solder pot 50, and a second fusing wire 51. Solder pot 50 is a cylindrical tubular pot for connecting first fusing wire 54 with second fusing wire 51. Wires 54, 51 are preferably a single thread of nickel-copper alloy wire, which is folded in half. Wire 54 is folded in half, forming loop 55 and end portions 56. Wire 51 is folded in half forming loop 62 and end portions 58. Wire end portions 58 and 56 terminate within solder pot 50 where they are nested within the circumferential inner surface of pot 50. The perimeter 63, formed by interconnecting the centers of each wire end 56, 58 with an imaginary line, may form the shape of a parallelogram. Each end 56 or 58 of the same wire 51 or 54 is disposed at the opposite corner of the parallelogram, such that the wire ends 56, 58 are staggered within the perimeter of the pot 50. This configuration ensures maximum heat dissipation and solder contact of the wire ends 56, 58 within pot 50 to ensure even heating thereof. Loop 55 of wire 54 is retained within tongue 108 of button 100, preferably by crimping loop 55 within the tubular inner diameter 47 thereof. As tubular inner diameter 47 of tongue 108 is slightly larger than twice the width of wire 54, the folded over portion or loop 55 is slightly smaller than inner diameter 47 and therefore when the tubular portion is pressed to crimp, the loop 55 is readily secured therein. Loop 62 is likewise crimped into ferrule 60. It has been found that if the total cross-sectional area of the multiple nickel copper fusing wire ends 56 or 58 extending into solder pot 50 from the adjacent tongue 43 or ferrule 60 is at least 0.00098 square inches, i.e., the combined cross section of the two parallel wire end portions 56 or 58 is at least 0.00098 inches, a fuse assembly 9 of the present invention having a rated amperage of 20 amps for high voltage transformer protection service will withstand normal lightning created surges without failure. By folding a single wire in half to obtain the total minimum cross section from the two resulting ends, a close match of cross section of the two parallel conductive paths is ensured, thereby eliminating possible overloading of a single wire of the pair. Although use of two wires has been described, multiple wires may be employed without deviating from the scope of the invention, if the cross-sectional area remains the same as would occur with a single folded wire. Further, other materials, such as stainless steel, may be used by compensating for the changes in materials when computing the thickness of the wires. Likewise, the total cross-sectional area of the wires must also be adjusted to compensate for different amperage ratings of the fuse assembly 9.

To determine the minimum cross-sectional area for wires made of other materials, the intended $i^2t$ of the fuse link 36 is determined for the specific amperage and voltage rating of the fuse, then the energy rating is determined from the resistivity, impedance and vaporizing characteristics of the material. This information is found in standard design handbooks. From this information, the total cross-sectional area of the wire is determined which is sufficient to supply the necessary $i^2t$ capacity for the rated amperage and fusing characteristics such as opening time. These calculations are well within the ability of one skilled in the art of fuse design. Likewise, the fusing wires 51, 54 need not be folded over, but may constitute individual strands which are soldered, welded, or otherwise physically and electronically affixed between the pot 50 and tongue 108 and between the pot 50 and the ferrule 60 of lead wire 32. Additional wires should also be placed within the pot 50 in the staggered fashion provided with the single folded wire ends 56 or 58.

To hold wire ends 56, 58 in pot 50, the juncture of pot 50 and wires 54, 51 is secured in solder 61. By varying the solder 61 used, the melting temperature of the juncture may be varied. As the temperature in the pot 50 is a function of the amount of heat generated by an overcurrent condition in wire ends 56, 58, a lower temperature solder 61 will melt at lower temperatures and thereby at lower amperage ratings. However, the nickel copper wires will withstand high, short duration, surge currents without failure, thereby permitting the fuse to withstand lightning surges in the power distribution network.

It has been found that the staggering of the wires provided uniform heating of pot 50, thereby permitting the use of low melting point solders 61 in pot 50 to create low amperage fuses. Further, by splitting the total cross-sectional area of the wires into two or more wires, the total area of adhesion or contact between the solder 61 and wire ends 56, 58 within pot 50 is increased, thereby increasing the resistance of the solder pot 50 and wire ends 56, 58 to movement or creep resulting from the tension of leader 32. If the wire cross-sectional area was not split into two or more wires, the total area of adhesion to solder 61 within pot 50 will be substantially less, which may lead to premature opening of pot 50 in response to rated current loads.

In addition to the improved surge characteristics of the fuse, it has been found that the sizes and materials of the fusing wires 51, 54 may be mismatched in order to take further advantage of the solder pot 50 design. For example, in a 10 amp fuse, it has been found that using a nickel-copper wire where the total cross section of the two parallel ends 56 of wire 51 is 0.020, and the total cross section of the two parallel ends 58 of wire 54 is 0.040, the fuse will give better fusing and clearing characteristics by virtually ensuring that fault current opening will occur in wire 51, but the overall sizing of the pot 50 and wires 51, 54, will essentially eliminate nuisance fuse openings which result from lightning and other weather-related effects and still provide fusing where a short or overload is present. By ensuring that the fault opening occurs between pot 50 and ferrule 60, the gasses and pressure which build within auxiliary tube 26 will be created immediately adjacent ferrule 60 and thus will immediately begin pushing ferrule 60, and the portions of wire 51 attached thereto, out of auxiliary tube 26, and will eliminate the time lag between fusing and expulsion which occurs when the fusing occurs in wire 54, on the opposite side of pot 50 from ferrule 60. The use of two different diameter wires, the smaller for proper fault opening and the larger, to combine with the smaller within pot 50 for proper overload opening, allows the fuse designer to customize the fuse for many contemplated fusing requirements and allows more consistent, faster clearing than prior art fuses. The designer may very fuse link size, span and material to vary fuse performance characteristics.

To ensure proper fusing characteristics of wire ends 56, 58 within pot 50, pot 50 is constructed from a length of ni-chrome or other wire 130 which is coiled into a tubular shape 132. Fusing links 51, 54 are assembled into pot 50 for soldering, but are first cleaned and prepared for soldering by being dipped in flux. The flux cleans the surfaces of the components to help ensure solder adherence thereto. The pot 50 with the wires 51,56 inserted therein, is then dipped in a solder bath or hand soldered. The instantaneous high heat of the solder can scorch the flux, causing burnt flakes of flux to adhere to the inside of the solder pot. Further, air pockets may exist within the pot which will interfere with complete coverage of the pot and wire surfaces with solder. The use of a wire coil for pot 50 significantly reduces the incidence of air voids and trapping of burnt flux within the pot. As the solder flows into the pot, air, and accumulated burnt flux, will travel out through the space or gap between the adjacent wire windings which form the circumferential wall of the pot 50. Further, the solder will coat a greater overall surface area than when a solid tube is used, by covering the curved surface of the wire, as opposed to a smooth inner surface of a ferrule, ensuring more even heating and predictable fuse performance.

Referring now to FIG. 5, fuse assembly 9 is shown mounted in dropout expulsion housing 10 supported on a pole (shown in FIG. 1). Retainer 12, holding dropout expulsion housing 10, includes an inner threaded recess 70 having an aperture 72 therethrough through which end 30 of inner tube 26 projects. Outer tube 11 is threadingly retained within inner threaded recess 70. To ensure electrical contact, and to help retain button 100 and inner tube 26 within outer tube 11 during high energy interruptions, upper end of retainer 12 includes outer threaded stud 74 through which aperture 72 and tube 26 project. Conductive end ferrule 13 is threaded over stud 74 to retain button 124 in place in bore 77 therein and to ensure electrical conductive engagement between retainer 12 and button 100. Head portion 124 of button 100 is smaller than aperture 72, and small head portion 124 therefore is tightly received in bore 74 of retainer 12, and holds inner auxiliary tube 26, fusing link 36 and leader 32 within outer tube 11.

Alternatively, as shown in FIG. 8, conductive end ferrule 13 includes a button bore 140 therein for receiving large head 128. The outer circumference of lip 134 contacts the inner wall of button bore 140 to ensure electrical engagement of fuse head 100 with ferrule 13.

Referring now to FIGS. 1, 5 and 8, trunnion 14 holds fuse 1 in place and serves to actuate or assist the separation of severed fuse wires during a fuse opening and includes a carrier 21 hinged thereto at 37 and also hinged to strap 17. Trunnion includes a slot (not shown), which terminates adjacent hinge 37 and extends downward therefrom. A pin 39 extends through carrier 21 at hinge 37 into the slot. Leader 32 extends outward from the open ends of tubes 11 and 26 of dropout expulsion housing 10 where it is electrically connected to carrier 21 with a thumbscrew 19. Carrier 21 includes a spring biased flipper 23 which is spring biased so as to tension leader 32 downwardly and outward of open end 15. Flipper 23 is a generally planar member, mounted over a stud 27 located on carrier 21. Carrier 21 is mounted on its lower end to carrier strap portion 9 of strap 17, which includes a hook portion 7 which receives a pin 5 extending through carrier 21. Hook portion 7 is comprised of a pair of fingers, with carrier supported therebetween on pin 5. A biasing spring 25, including a tension arm 28 extending therefrom, is mounted over stud 27 such that arm 27 engages flipper 23 to bias it in a downward direction. Flipper 23 is mounted on stud 27 such that flipper may arcuately move with respect to the stud 27, the stud 27 serving as a center point of such arcuate movement.

Leader 32 is normally retained within tube 26 and crimped or otherwise attached to ferrule 60, and therefore flipper 23 is held in the upper position shown in FIG. 5. When a long-term low overload condition is encountered by fuse assembly 9, the fuse link 36 in tube 26 severs as wire end portions 56 or 58 pull out of pot 50, and the tension on leader 32 is relieved and flipper 23 moves down to force leader 32 out of the open end 15 thereby opening the circuit. When flipper 23 flips downward, the carrier 21 slides downward on pin 39 in the slot in trunnion 14. This motion slides carrier 12 below a spring clip (not shown) on a bracket on pole 18, thereby freeing the upper end of fuse 1 from the pole 18. The upper end of the fuse then kicks outward while the lower end is retained in carrier strap 9 through pin 5. To initiate the opening of the fuse to open the circuit to the transformer 20 in response to a long-term low overload condition, solder in pot 50 melts when sufficient heat has been generated to raise the solder temperature to the melting point. At this point, flipper 23 pulls leader 32 outward open end 15, thus pulling ends 58 out of pot 50 or pulling pot 50 off of ends 58 to open the circuit. As discussed above, when tension is relieved on the leader 32, the fuse 1 will kick out of the upper portion of the pole 18 to indicate a fuse open condition.

In response to a high energy fault, the wire ends 56 and 58 melt and vaporize. As a result of arcing which occurs when the wire ends 56, 58 vaporize, the solder in pot 50 melts and becomes gaseous. Likewise, water in the tube 26 becomes vaporous. The melting and vaporization of wire ends 56, 58 opens the circuit in response to short circuit, thereby protecting the transformer. The pressure which builds in auxiliary tube 26 bears against ferrule 60, which causes a force bearing on ferrule 60 which also causes ferrule 60, portions of the fusing link attached thereto to be forcibly ejected out the open end 15 of the fuse 1. Where link 51 is smaller in cross-sectional than link 54, the fuse opening will occur as vaporization of link 51. Additionally, link 51 may include reduced cross-sectional areas, which will likely vaporize first in a short circuit condition. Again, the fuse 1 kicks out to indicate a fuse opening.

While a preferred embodiment of the invention has been shown and described, modifications thereof can be made by one skilled in the art without departing from the spirit of the invention.

We claim:

1. A fusing system for interconnection into a circuit in a dropout expulsion fuse, comprising:

a first multi-element fusing wire having a first circuit interconnection end and a second pot end;

a second multi-element fusing wire having a first circuit interconnection end and a second pot end;

said pot end of said first and second fusing wires received within a solder pot;

said pot having an outer annular wall formed from a winding of wire;

said first multi-element fusing wire and said second multi-element fusing wire having multiple elements forming distinct current carrying paths between said interconnection ends and said pot ends.

2. The fusing system of claim 1, wherein said first multi-element fusing link and said second multiple element fusing link are selected from different materials.

3. The fusing system of claim 1, wherein said fusing wire have different cross-sectional areas.

4. A fused protection system for protecting high-energy power distribution components, comprising:

a fuse holder having an upper end ferrule, a lower trunnion, and an outer tube disposed therebetween;

a fusing subassembly received within said outer tube, said fusing subassembly including an auxiliary tube encircling a dual function fusing element, and a user size selective button disposed on one end thereof;

said button received within a button bore of said end ferrule;

said button having a first large diameter head portion and a second, small diameter head portion, said large diameter head portion removably disposed on said small diameter head portion; and said button bore sized to receive one of said large or small head portions upon selection thereof by the fuse installer.

5. The fuse of claim 4, wherein said large diameter head portion is a removable washer.

6. The fuse of claim 4, wherein said large diameter head portion is a removable cap.

7. A fusing assembly for protecting high voltage electric distribution equipment which is interconnected to a high voltage conductor, comprising:

a first fusible wire having first and second ends and a second fusible wire having first and second ends;

said first end of said first wire and first end of said second wire interconnected in a solder pot, said second end of said first wire interconnected to the high voltage conductor and said second end of said second wire interconnected to the high voltage electric distribution equipment;

the cross-section of said first wire and the cross-section of said second wire having different areas.

8. The fusing assembly of claim 7, wherein said solder pot is a wire wound spirally to form an annulus, and said first ends of said first and second wires are received within said pot.

9. A fuse assembly, comprising:

a first fuse wire having a first end portion including multiple elements and a second end portion including at least one element;

a second fuse wire having a first end portion including multiple elements and a second end portion including at least one element;

at least one of said multiple elements in said first fuse wire or second fuse wire forming independent electrical current carrying paths from said first end portion to said second end portion thereof;

said first end portions of said first fuse wire and said second fuse wire received in a solder pot; and the total cross sectional area of the multiple elements of said first fuse wire having a different cross-sectional area than the total cross sectional area of the multiple elements of said second fuse wire.

10. The fuse assembly of claim 9, wherein said multiple elements of said first and said second fuse wires are two elements.

11. The fusing assembly of claim 9, wherein said first fuse wire is a single length of wire, and said multiple elements at said first end portion are formed from the opposite ends of said first wire.

12. A fuse assembly, comprising:

a first fusing wire having a first end and a second end;

a second fusing wire having a first end and second end;

a discrete length of wire having opposed wire ends wound into a solder pot having an internal fuse wire receiving portion and opposed open ends, one of said opposed wire ends disposed adjacent each pot opposed open end; said first ends of said first and second fuse wires received in said pot.

13. The fuse assembly of claim 12, wherein said first fusing wire includes multiple discrete current carrying paths.

14. The fuse assembly of claim 12, wherein said first fusing wire has a first cross-section and said second fuse wire has a second cross section, and said first cross-section and said second cross-section are different.

15. The fuse assembly of claim 13, wherein said second fusing wire includes multiple discrete current carrying paths.

16. The fuse assembly of claim 15, wherein said multiple current carrying paths of said first fusing wire and said second fusing wire are formed of multiple fusing elements at said first end of said first fuse wire and said first end of said second fuse wire;

and, said multiple elements are received within said solder pot.

17. The fusing assembly of claim 16, wherein said solder pot is disposed intermediate said first fusing wire and said second fusing wire, and said multiple elements of said first fusing wire are received in one of said pot open ends, and said multiple ends of said second fusing wire received in the opposite open end of said pot.

18. The fusing assembly of claim 17, wherein said multiple elements are nested within said pot.

19. The fuse assembly of claim 18, wherein said first fusing wire has a first cross-section and said second fuse wire has a second cross section, and said first cross-section and said second cross-section are different.

* * * * *